US006112684A

United States Patent [19]

Papajewski

[11] Patent Number: 6,112,684

[45] Date of Patent: Sep. 5, 2000

[54] MAGNETIC REVOLVING SHUTTLE FOR DOUBLE-STITCH SEWING MACHINES

[76] Inventor: Gerd Papajewski, Karlsruher Ring 30, 76297 Stutensee, Germany

[21] Appl. No.: 09/390,315

[22] Filed: Sep. 3, 1999

[30] Foreign Application Priority Data

Sep. 8, 1998 [DE] Germany ..... 198 40 956

[51] Int. Cl.[7] ..... D05B 57/20

[52] U.S. Cl. ..... 112/185; 112/188; 112/231

[58] Field of Search ..... 112/180, 185, 112/188, 196, 279, 228, 231

[56] References Cited

U.S. PATENT DOCUMENTS

| | | | |
|---|---|---|---|
| 2,394,369 | 2/1946 | Colegrove | 112/228 |
| 2,690,726 | 10/1954 | Wener | 112/231 |
| 2,763,227 | 9/1956 | Howard | 112/231 |
| 2,784,690 | 3/1957 | Brandt | 112/188 |
| 4,284,017 | 8/1981 | Starr . | |
| 5,152,236 | 10/1992 | Hirose . | |

FOREIGN PATENT DOCUMENTS

| | | |
|---|---|---|
| 0489980 | 6/1992 | European Pat. Off. . |
| 0409771 | 3/1925 | Germany . |
| 2953743 | 1/1981 | Germany . |
| 8234141 | 7/1985 | Germany . |
| 0332443 | 3/1958 | Switzerland . |
| 8100120 | of 0000 | WIPO . |

*Primary Examiner*—Ismael Izaguirre
*Attorney, Agent, or Firm*—William A. Drucker

[57] ABSTRACT

A revolving shuttle for double-stitch sewing machines having an improved thread-holding capacity without a substantial increase in the volume of the bobbin case, and allowing an easy removal of the bobbin case. The novel shuttle comprises a bobbin case which can be removed from the shuttle by a magnet. The fact that the bobbin consists in part of a ferromagnetic material guarantees safe removal of the bobbin case and the bobbin. This allows the conventional mechanical removal mechanism arranged on the end face of the bobbin case to be omitted, and provides the possibility either to use a larger bobbin with unchanged volume of the bobbin case, or to reduce the volume of the bobbin case for a normal bobbin.

12 Claims, 2 Drawing Sheets

MAGNETIC REVOLVING SHUTTLE FOR DOUBLE-STITCH SEWING MACHINES

BACKGROUND OF THE INVENTION

The invention relates to a shuttle for double-stitch sewing machines with horizontally arranged shuttle shaft according to the preamble of claim 1.

A shuttle corresponding to the preamble of claim 1 has been known from European Patent Application EP 0 489 980 A1.

In the case of that shuttle, the upper part of the bobbin case is friction-locked in the lower part of the bobbin case by a permanent magnet.

This arrangement results in a simple design and simplifies the operation of exchanging the bobbin.

On the external end face of the bobbin case removal means and/or thread-tightening means are provided in a known fashion.

However, no possibility of increasing the thread-holding capacity is disclosed, and the removal of the upper part of the bobbin case has not been generally improved, either.

In order to increase the thread-holding capacity of double-stitch shuttles, without applying greater changes to the sewing machine, a number of different solutions have already been proposed. The shuttle from Durkopp-Adler, part No. 271 2091, has a greater thread supply, and another shuttle with greater thread supply is known from German utility model DE 8234141 U1.

Both shuttles can be used in existing sewing machines without substantial changes. The increase of the thread-holding capacity of the shuttle is achieved in these cases substantially by an increase of the volume of the bobbin case. Consequently, these shuttles pull a greater length of needle thread below the needle plate to form the needle thread loop. This is disadvantageous under technical aspects because it subjects the needle thread to increased stress and because the thread take-up characteristics are no longer optimally balanced.

Especially when sewing at high speeds, this may lead to sewing problems.

For removing and locking the upper part of the bobbin case, both before-mentioned shuttles make use of a conventional locking and removal mechanism arranged on the external end plate of the upper part of the bobbin case.

This locking and removal mechanism has for many decades proved its value with shuttles having a horizontally arranged shuttle shaft.

For removing the upper part of the bobbin case, a tilting lever is tilted using the finger nails, which has the effect that a slide releases the form-locking engagement of the upper part of the bobbin case in the lower part of the bobbin case, while fixing at the same time the bobbin in the upper part of the bobbin case. By gripping the tilting lever between the forefinger and the thumb, the upper part of the bobbin case can then be axially withdrawn from the lower part of the bobbin case, together with the bobbin.

It is a disadvantage of this mechanism that it requires relatively much space, which has a negative influence on the needle thread demand of the shuttle.

In addition, tilting the tilting lever with a finger nail is a relatively complicated and uncomfortable operation.

From DE 29 53 743 A1 a shuttle has been known where the thread supply is said to be increased by having the bobbin placed directly in a single-part bobbin case where it is retained by magnetic force. Thus, the volume of the omitted upper part of the bobbin case is available for increasing the thread-holding capacity of the shuttle. The necessary thread tension is said to be produced in this case by friction between the bobbin and the bottom of the bobbin case.

For removing the bobbin, a slot is provided in the bobbin case so that the bobbin can be pulled off with the finger nails.

This shuttle has never been successful in practice, because the thread tension cannot be kept constant. At constant torque, which is required to rotate the bobbin, the thread tension is almost four times higher when the bobbin is almost empty than when it is full. In addition, the way of removing the bobbin is extremely awkward for the operator.

SUMMARY OF THE INVENTION

It is a first object of the invention to disclose a shuttle which provides for an increased volume of the bobbin case, particularly for achieving a high thread-holding capacity. It is a further object of the invention to provide a shuttle, wherein the upper part of the bobbin case and the bobbin can be removed simply and safely.

These and other objects are achieved by a shuttle comprising the features of claim 1.

The advantages achieved by the invention lie essentially in the fact that the volume of the bobbin case of existing shuttles need not be notable increased in order to increase the thread-holding capacity of the shuttle.

The additional space required for an enlargement of the bobbin by up to 30% in axial direction, is obtained by making the end plate of the upper part of the bobbin case as thin-walled as possible.

Due to this improved utilization of space it is ensured that a shuttle with a bobbin extended correspondingly in axial direction, according to the invention, has almost the same needle thread demand as a conventional shuttle so that the sewing characteristics are not negatively affected.

Given the fact that the shuttle body may remain unchanged with respect to its radial dimensions, the novel shuttle can be used in existing machines without any changes. Advantageously, the thread-holding capacity may be increased once more by the additional use of known shuttle designs, such as an eccentric arrangement of the bobbin in the bobbin case (German patent specification DE 409 771).

Particular advantages are achieved with the shuttle design according to the invention in the case of shuttles whose bobbin lies beneath or in front of the path of movement of the needle, as in the case of shuttles according to German utility model DE 8234141 U1 or shuttles for zigzag sewing machines, for example. In the case of such shuttles it is possible, simply by using an upper part of the bobbin case and a bobbin according to the invention, to either reduce the needle thread demand or to increase the thread-holding capacity.

Another advantage is provided by an external removal device that consists, for example, of a magnet and that no longer requires special dexterity. This simplifies the removing operation. At the same time, such a removal device also has the effect to reduce the production costs of the bobbin case, because it does without the conventional removal mechanism and the stem in the lower part of the bobbin case.

The use of a bobbin that consists at least in part of a ferromagnetic material, and of an upper part of the bobbin case with slight permanent-magnetic properties according to the invention ensures that when inserting the bobbin without a removal magnet, the bobbin will not inadvertently drop from the upper part of the bobbin case.

When removing the bobbin, the indirect action of the removing magnet on the bobbin will suffice to prevent the latter from dropping off the upper part of the bobbin case. In practice, bobbins made from aluminum have been successful due to their lower inertia moment.

This advantage is not lost in an arrangement according to the invention as the bobbin is made from a ferromagnetic material only in part, and in an uncritical area.

SHORT DESCRIPTION OF THE DRAWINGS

Two embodiments of the invention and the prior art will be described and explained below in more detail, with reference to FIGS. 1 through 4 in which.

DETAILED DESCRIPTION OF THE PREFERRED EMBODIMENTS

Figure 1:
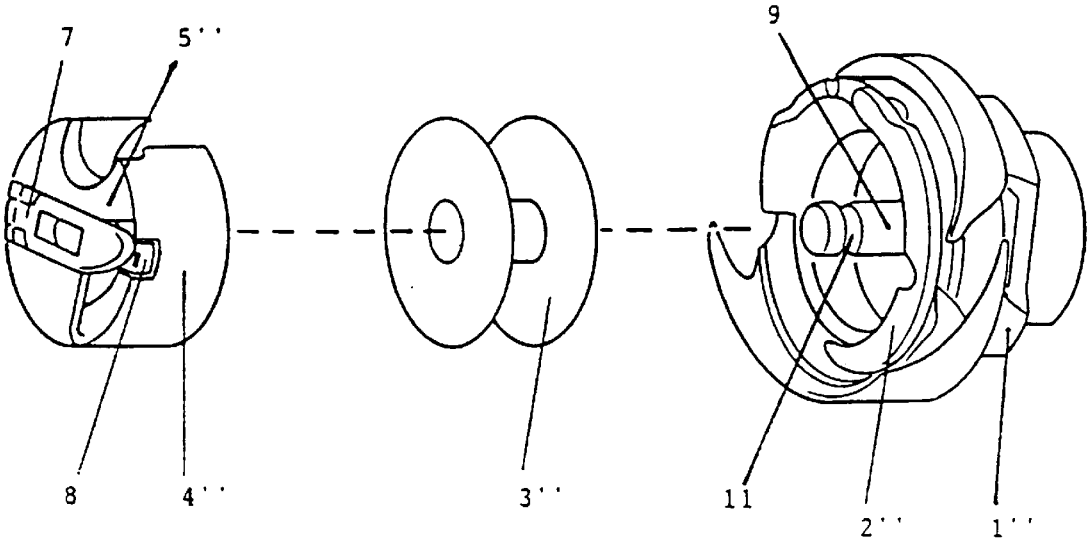
FIG. 1 Prior Art
FIG. 1 shows an exploded view of a straight-stitch shuttle (prior art)

FIG. 1 shows a double-stitch shuttle for a sewing machine with horizontally arranged shuttle shaft, the function of which is well known to any man skilled in the art.

A shuttle of this type is used for example in high-speed sewing machines. For purposes of the invention it is relevant that during the sewing process a loop of the needle thread is guided around the bobbin case 2", 4". Any enlargement of the volume of the bobbin case leads to an increase of the length of that loop and, thus, to the needle thread being subjected to greater stress. At the same time, the needle-thread demand curve also changes, which may require changes to the thread pick-up mechanics and may have negative influences on the sewing properties, especially when working at high speeds.

The bobbin case consists of a lower part 2" being rotatably supported in a shuttle body 1". Received in the lower part 2" of the bobbin case is an upper part 4" of the bobbin case which accommodates a bobbin 3" carrying the thread supply.

Mounted to the end plate 5" of the upper part 4" of the bobbin case is a locking and removal device consisting of a tilting lever 7 and a slide 8. During the sewing operation, the slide 8, engaging a groove 11 in the stem 9, ensures that the upper part 4" of the bobbin case is positively held in the lower part 2" of the bobbin case.

Figure 2:
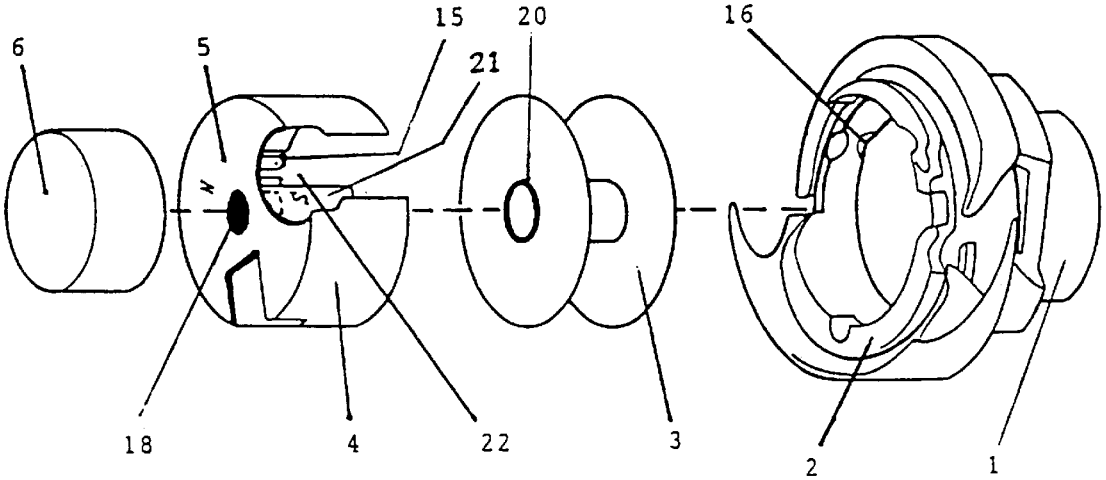
FIG. 2 shows an exploded view of a shuttle according to a first embodiment of the invention.

FIG. 2 shows a double-stitch shuttle similar to FIG. 1, according to one embodiment of the invention.

As provided for by the invention, the upper part 4 of the bobbin case is terminated by an end plate 5 which exhibits a thin-walled design, and there are no locking and removal devices on the end plate. The end plate 5 may be as thin as possible, reaching from 0.2 to roughly 2 mm, with a thickness of roughly 0.5 mm in the preferred embodiment. By contrast, in prior art designs, the end plate would accommodate a locking and removal device and would, therefore, have a thickness of at least 3 mm.

The path of movement of the needle is located in front of the bobbin 3 in the present example, and the needle dips into a recess 22 in the upper part 4 of the bobbin case during the sewing operation.

The bobbin 3 comprises a tubular insert 20, preferably made from steel, which may, for example, be pressed in. The remaining body of the bobbin consists of a material of low unit weight, advantageously of aluminum.

Figure 3:
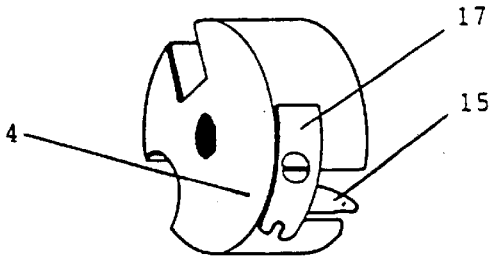
FIG. 3 shows a perspective view of the upper part of the bobbin case according to FIG. 2, turned by 180 degrees.

At the end face of the upper part 4 of the bobbin case a permanent magnet 18 is mounted, for example pressed into the stem 21 of the bobbin case. The removal device is made from steel. Further, FIGS. 2 and 3 show a variant of a friction-locking retaining device consisting of a spring arm 15, formed on the upper part 4 of the bobbin case, and a protrusion 16 on the lower part 2 of the bobbin case.

Once the thread has been wound up on the bobbin 3, the latter is inserted into the upper part 4 of the bobbin case, and the thread is threaded up in the thread-tightening device 17.

Due to the fact that a magnetic force acts between the permanent magnet 18 and the inner part 20 of the bobbin, the bobbin is secured from dropping off inadvertently.

Now the upper part 4 of the bobbin case, together with the bobbin 3, is introduced into the lower part 2 of the bobbin case either directly or by means of the removal device 6, until the spring arm 15 snaps into the recess 16.

The upper part 4 of the bobbin case is now positively locked in the lower part 2 of the bobbin case.

If the upper part 4 of the bobbin case is inserted with the aid of the removal device 6, the latter is then withdrawn to the side.

For removal, the removal device 6 is approached axially to the upper part 4 of the bobbin case; the magnetic attraction between the permanent magnet 18, consisting preferably of rare earths, and the removal device 6 is selected to be stronger than the axial retaining force acting between the upper part 4 of the bobbin case and the lower part 2 of the bobbin case.

This ensures that the upper part 4 of the bobbin case, together with the bobbin 3, can be withdrawn from the lower part 2 of the bobbin case by means of the removal device 6. Making the removal device an external part, and having the bobbin 3 held in the bobbin case 4 by magnetic force, permits the end plate 5 of the upper part 4 of the bobbin case to be given a thin-walled design.

This has the effect, in the described example, to reduce the needle thread demand while the thread-holding capacity remains unchanged.

Another embodiment of the invention permits the bobbin 3 to be axially enlarged by axially extending the upper part 4 of the bobbin case and axially extending the lower part 2 of the bobbin case in the direction of the shuttle shaft, with only a slight change in needle thread demand, compared with conventional shuttles.

Figure 4:
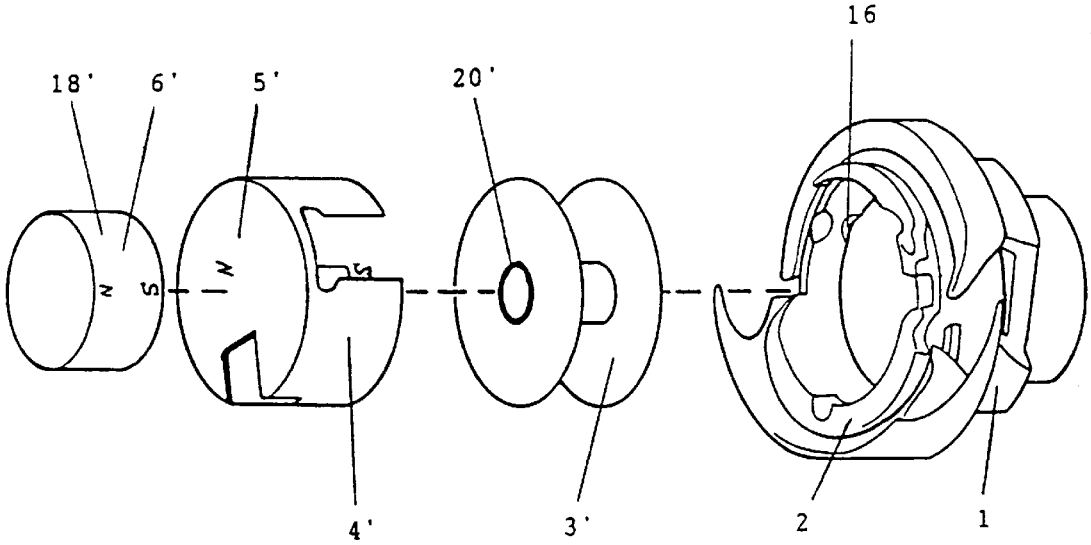
FIG. 4 shows an exploded view of a shuttle according to another embodiment of the invention.

FIG. 4 shows still another embodiment of the invention. In this case, the path of movement of the needle is located above the bobbin 3'. The removal device 6' takes the form of a permanent magnet 18'. The upper part 4' of the bobbin case is magnetized in axial direction in that case. The magnetization must only be strong enough to ensure that the bobbin 3 is slightly retained in the upper part 4' of the bobbin case, when being inserted without the removal device 6', so that it is prevented from dropping off inadvertently. During removal, the magnetic force of the removal device 6' also acts to indirectly attract the bobbin 3'. This additionally ensures that the upper part 4' of the bobbin case can be removed together with the bobbin 3' and that the bobbin 3' is secured against dropping off inadvertently.

In contrast to the first embodiment, this arrangement permits the thread-holding capacity to be increased by approximately 20% by the axial extension of the upper part 4 of the bobbin case and of the bobbin 3', with an only slightly changed needle thread demand.

In the case of shuttles where the path of movement of the needle is located behind the bobbin, as is the case for example with zigzag shuttles, an increase of up to 30% of the thread-holding capacity is even possible by means of the before-mentioned features.

The embodiment according to the invention can be realized with all shuttles equipped with conventional locking and removal devices without greater constructional input.

What is claimed is:

1. A revolving shuttle in a double-stitch sewing machine having a horizontally arranged shuttle shaft, said revolving shuttle comprising:

a shuttle body;

a bobbin case rotatably seated on said shuttle body and comprising a lower part and an upper part, said upper part being made from a ferromagnetic material and being adapted for receiving a bobbin made at least partially from a ferromagnetic material and for carrying a thread supply, said lower part of said bobbin case being adapted for receiving said upper part together with said bobbin;

a locking means for retaining said upper part of said bobbin case on said lower part of said bobbin case in friction-locked engagement with a certain retaining force;

a thread-tightening element arranged on said upper part of said bobbin case;

an end plate terminating said upper part of said bobbin case;

a removal device for withdrawing the upper part of the bobbin case, together with the bobbin, from the lower part of the bobbin case, said removal device being external to said upper part of said bobbin case and comprising, at least partially, a ferromagnetic material;

wherein a magnetic force of attraction between said removal device and said upper part of said bobbin case, exerted when in contact with each other, is greater than said retaining force acting between said upper and said lower parts of said bobbin case.

2. The revolving shuttle of claim 1, wherein said outer end plate is free from any removal devices and thread-tightening devices, that would take up space in axial direction.

3. The revolving shuttle according to claim 1, wherein said end plate of said upper part of said bobbin case exhibits a substantially flat and thin-walled design in the region where the bobbin is received.

4. The revolving shuttle of claim 1, wherein said bobbin comprises an inner part consisting of a ferromagnetic material, and a remaining part consisting of a non-ferromagnetic material.

5. The revolving shuttle of claim 1, wherein the bobbin and the upper part of the bobbin case are extended in axial direction.

6. The revolving shuttle of claim 1, wherein the bobbin, as well as the upper part of the bobbin case and the lower part of the bobbin case are extended in axial direction.

7. The revolving shuttle of claim 1, wherein a magnetic force of attraction is exerted between the upper part of the bobbin case and the bobbin.

8. The revolving shuttle of claim 7, wherein said bobbin comprises an inner part having permanent-magnetic properties.

9. The revolving shuttle of claim 7, wherein the upper part of said bobbin case exhibits permanent-magnetic properties sufficient to retain said bobbin within said upper part.

10. The revolving shuttle of claim 1, wherein the removal device exhibits permanent-magnetic properties.

11. The revolving shuttle of claim 1, wherein said upper part of said bobbin case comprises a bobbin stem wherein a permanent magnet is arranged, allowing removal of said bobbin together with said upper part of said bobbin case, when brought into contact with said removal device.

12. The revolving shuttle of claim 1, wherein said upper part of said bobbin case further comprises at least one spring arm, and wherein said lower part of said bobbin case comprises at least one protrusion, said spring arm and said protrusion being designed and arranged with respect to one another to allow snap-engaging of said spring arm and said protrusion, when said upper part of said bobbin case is seated in said lower part of said bobbin case, and to provide a friction-locking connection in axial direction between said upper and said lower parts of said bobbin case.

* * * * *